US006520430B2

(12) United States Patent
Chao

(10) Patent No.: US 6,520,430 B2
(45) Date of Patent: Feb. 18, 2003

(54) PROSTRATE GARDEN SPRINKLER BASE

(76) Inventor: Hui-Chen Chao, 75, Liau Tsuo Hsiang, Liau Tsuo Li, Lu Kang Chen, Chan Hua Hsien (TW)

( * ) Notice: Subject to any disclaimer, the term of this patent is extended or adjusted under 35 U.S.C. 154(b) by 11 days.

(21) Appl. No.: 09/828,684

(22) Filed: Apr. 9, 2001

(65) Prior Publication Data

US 2002/0145059 A1 Oct. 10, 2002

(51) Int. Cl.[7] ..... B05B 15/00; B05B 1/14; A62C 2/08

(52) U.S. Cl. ..... 239/548; 239/547; 239/553.3; 239/553.5

(58) Field of Search ..... 239/547, 548, 239/553, 553.3, 553.5, 562, 568, 569; 405/45, 43, 36, 52

(56) References Cited

U.S. PATENT DOCUMENTS 4,139,159 A * 2/1979 Inoue et al. ..... 239/547
4,285,472 A * 8/1981 Okada et al. ..... 239/542
4,577,997 A * 3/1986 Lehto et al. ..... 405/43
4,721,408 A * 1/1988 Hewlett ..... 405/48
4,904,112 A * 2/1990 McDonald ..... 405/45

FOREIGN PATENT DOCUMENTS

FR 2605492 A * 10/1986 ..... A01G/25/02

* cited by examiner

*Primary Examiner*—Michael Mar
*Assistant Examiner*—Davis Hwu
(74) *Attorney, Agent, or Firm*—Harrison & Egbert

(57) ABSTRACT

A prostrate garden sprinkler base comprises a prostrate main body provided with a hose connector, a spray tube member in communication with the hose connector, and a shield for concealing and protecting the spray tube member. The shield is provided with a plurality of through slots which are arranged in such a pattern that water streams emitted by jet nozzles of the spray tube member are sprayed out via the through slots of the shield for watering a garden, lawn, golf course, and the like.

2 Claims, 2 Drawing Sheets

PROSTRATE GARDEN SPRINKLER BASE

BACKGROUND OF THE INVENTION

1. Field of the Invention

The present invention relates generally to a garden sprinkler, and more particularly to a prostrate base of the garden sprinkler.

2. Description of Related Art

The conventional prostrate garden sprinkler base comprises one or more spray tubes which are exposed and are therefore susceptible to disintegration. In addition, the spray tubes are poorly arranged such that they undermine the overall esthetic effect of the sprinkler base.

BRIEF SUMMARY OF THE INVENTION

The primary objective of the present invention is to provide a prostrate garden sprinkler base which is free of the shortcomings of the conventional prostrate garden sprinkler base described above.

In keeping with the principle of the present invention, the foregoing objective of the present invention is achieved by the prostrate garden sprinkler base which comprises a prostrate main body, one or more spray tubes, and a shield intended to enhance the overall external appearance of the sprinkler base and to provide the spray tubes with protection against the effect of washer.

The features and functions of the present invention will be more readily understood upon a thoughtful deliberation of the following detailed description of the present invention in reference to the accompanying drawings.

DETAILED DESCRIPTION OF THE INVENTION

Figure 1:
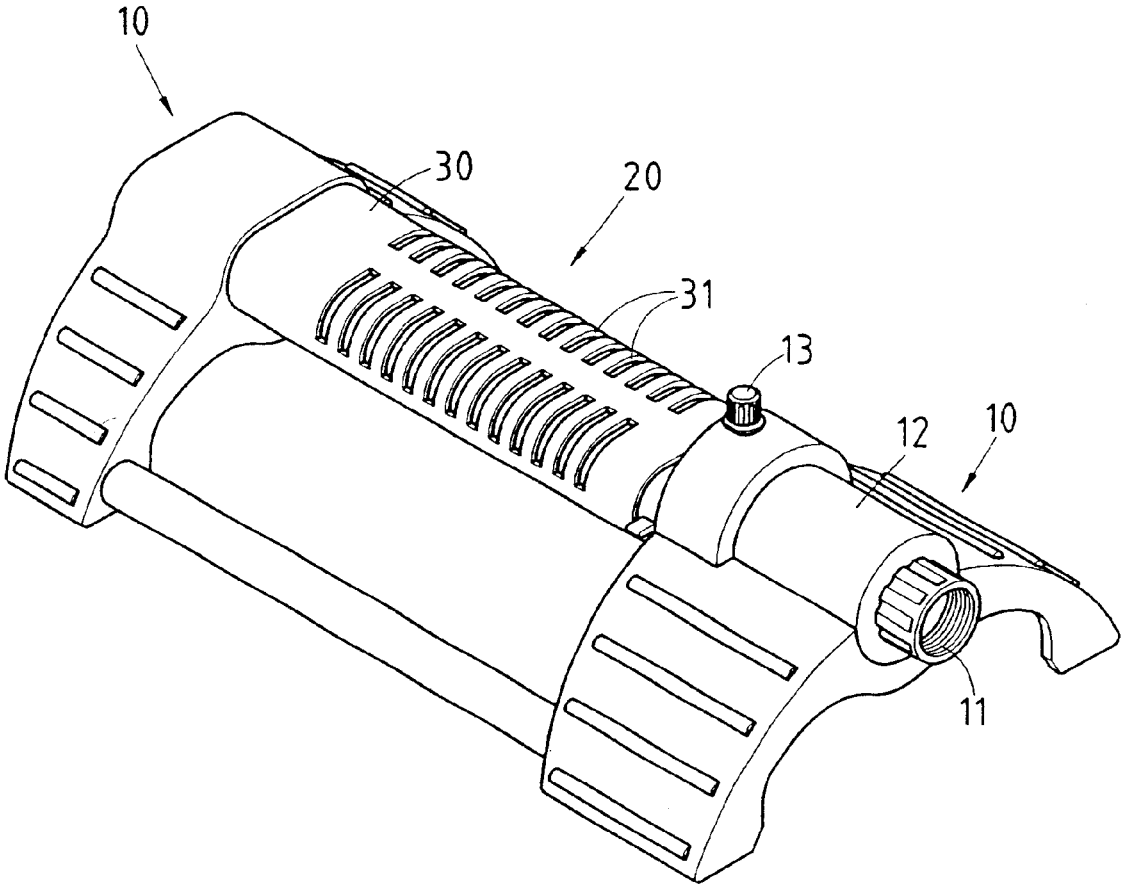
FIG. 1 shows a perspective view of the present invention.
Figure 2:
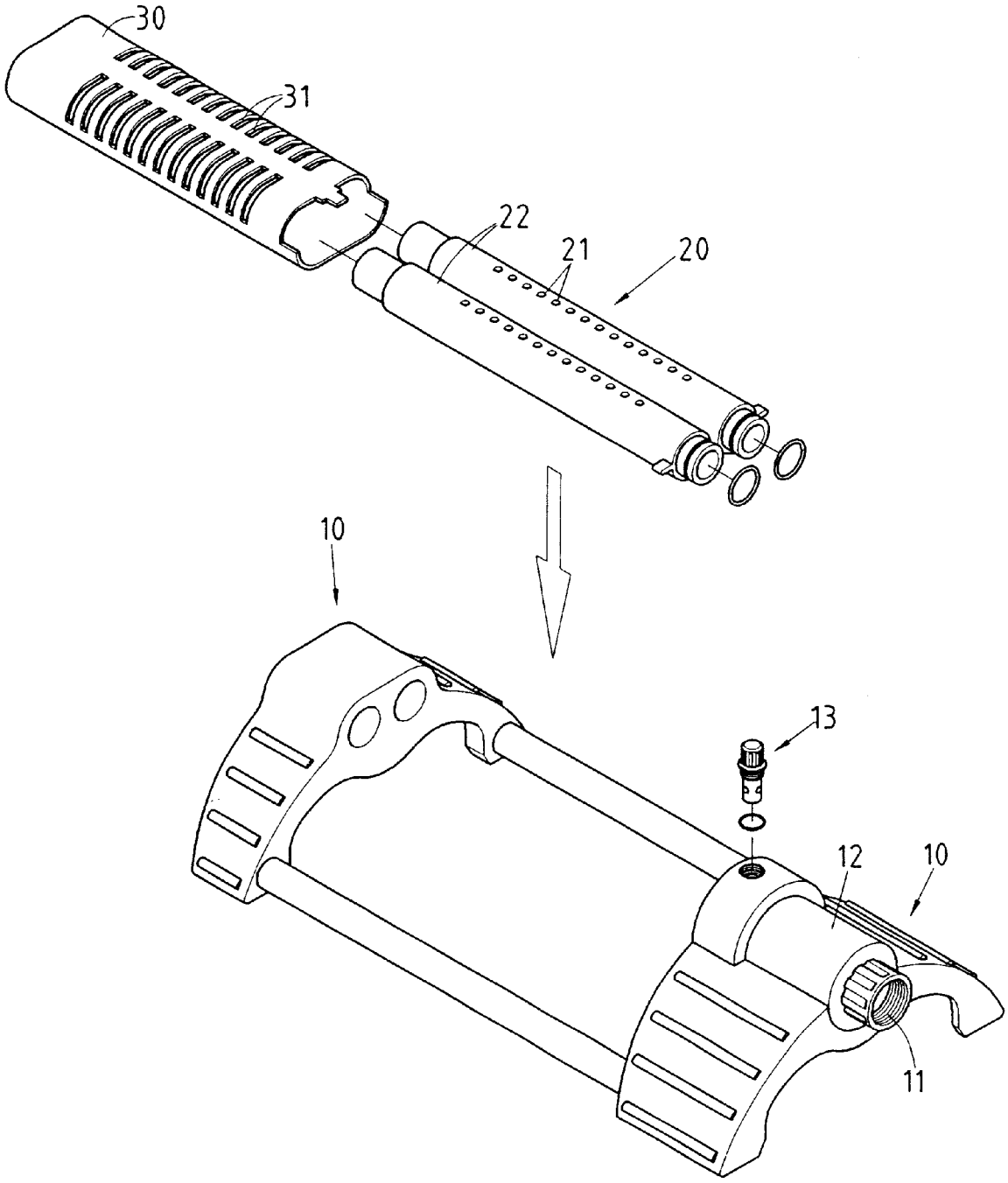
FIG. 2 shows an exploded view of the present invention.

As shown in FIGS. 1 and 2, a prostrate garden sprinkler base of the present invention comprises a prostrate main body 10, a spray tube member 20, and a shield 30.

The main body 10 is provided at one end with a hose connector 11, a water channel 12 in communication with the hose connector 11, and a water control valve 13 located at the internal end of the water channel 12.

The spray tube member 20 is connected at one end with the water control valve 13 and is formed of one or more spray tubes 22, with each having a plurality of jet nozzles 21 for emitting a stream of water.

The shield 30 is shaped and dimensioned to house the spray tube member 20. The spray tube member 20 is concealed by the shield 30 such that the spray tube member 20 is provided with protection against the action of weather, so as to prolong the service life span of the spray tube member 20. The shield 30 is provided in the upper side wall with one or more rows of through slots 31, which are corresponding in location to the jet nozzles 21 of the spray tubes 22 of the spray tube member 20. In operation, the water streams emitted by the jet nozzles 21 of the spray tubes 22 are sprayed out through the through slots 31 of the shield 30 for watering a lawn, golf course, etc.

In light of the concealment of the spray tube member 20 by the shield 30, the garden sprinkler base of the present invention looks neat.

The prostrate garden sprinkler base of the present invention described above is to be regarded in all respects as being merely illustrative and not restrictive. Accordingly, the present invention may be embodied in other specific forms without deviating from the spirit thereof. The present invention is therefore to be limited only by the scope of the following claim.

I claim:

1. A prostrate water sprinkler comprising:

a main body having a hose connector at one end thereof, said main body having a water channel in communication with said hose connector, said main body having a bottom surface;

a water control valve mounted to said main body at an end of said water channel;

a spray tube member connected at one end to said water control valve and rotatably supported in a position above said bottom surface of said main body, said spray tube member being a generally rigid member having a plurality of jet nozzles suitable for emitting a stream of water; and a tubular shield affixed to said main body and covering said spray tube member, said shield having a plurality of through slots corresponding respectively to said plurality of jet nozzles of said spray tube member so as to allow water from the jet nozzle to pass through the through slot outwardly of said main body, each of said jet nozzles having a range of movement relative to a rotatable movement of said spray tube member, each of said plurality of through slots having a length corresponding to the range of movement of the jet nozzle.

2. The sprinkler of claim 1, said spray tube member comprising a plurality of spray tubes, said shield being a unitary member covering said plurality of spray tubes.

* * * * *